US007305943B2

(12) United States Patent
Norton

(10) Patent No.: US 7,305,943 B2
(45) Date of Patent: Dec. 11, 2007

(54) ELECTROMAGNET ASSEMBLY FOR ELECTROMECHANICAL VALVE ACTUATORS

(75) Inventor: John D. Norton, Candler, NC (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 295 days.

(21) Appl. No.: 11/065,408

(22) Filed: Feb. 23, 2005

(65) Prior Publication Data

US 2006/0185634 A1 Aug. 24, 2006

(51) Int. Cl.
*F01L 9/04* (2006.01)

(52) U.S. Cl. ..... 123/90.11; 251/129.01; 251/129.16

(58) Field of Classification Search ..... 123/90.11; 251/129.01, 129.02, 129.15, 129.16, 129.18
See application file for complete search history.

(56) References Cited

U.S. PATENT DOCUMENTS

| | | | | |
|---|---|---|---|---|
| 2,877,390 | A | 3/1959 | Trombetta | |
| 3,609,609 | A | 9/1971 | Bertazzi | |
| 3,791,408 | A | 2/1974 | Saitou et al. | |
| 3,882,833 | A | 5/1975 | Longstaff et al. | |
| 3,959,759 | A | 5/1976 | Reuting | |
| 4,762,095 | A | 8/1988 | Mezger et al. | |
| 4,878,464 | A | 11/1989 | Richeson, Jr. et al. | |
| 4,883,025 | A | 11/1989 | Richeson, Jr. | |
| 5,339,063 | A | 8/1994 | Pham | |
| 5,566,921 | A | 10/1996 | Yokota et al. | |
| 5,636,601 | A | 6/1997 | Moriya et al. | |
| 5,772,179 | A | 6/1998 | Morinigo et al. | |
| 5,832,883 | A | 11/1998 | Bae | |
| 6,032,925 | A | 3/2000 | Izuo et al. | |
| 6,047,673 | A | 4/2000 | Lohse et al. | |
| 6,049,264 | A | 4/2000 | Sailer et al. | |
| 6,085,704 | A | 7/2000 | Hara | |
| 6,089,197 | A | 7/2000 | Lange et al. | |
| 6,101,992 | A | 8/2000 | Pischinger et al. | |
| 6,116,570 | A | 9/2000 | Bulgatz et al. | |
| 6,118,366 | A * | 9/2000 | Bulgatz et al. | 336/234 |
| 6,157,277 | A | 12/2000 | Bulgatz et al. | |
| 6,237,550 | B1 | 5/2001 | Hatano et al. | |
| 6,267,351 | B1 | 7/2001 | Schneider | |
| 6,289,858 | B1 | 9/2001 | Altdorf et al. | |
| 6,359,435 | B1 | 3/2002 | Czimmek et al. | |
| 6,373,361 | B1 | 4/2002 | Umemoto et al. | |
| 6,397,798 | B1 | 6/2002 | Fiaccabrino | |
| 6,418,892 | B1 | 7/2002 | Donce et al. | |
| 6,427,650 | B1 | 8/2002 | Cristiani et al. | |
| 6,453,855 | B1 | 9/2002 | Di Lieto et al. | |
| 6,467,441 | B2 * | 10/2002 | Cristiani et al. | 123/90.11 |
| 6,501,358 | B2 | 12/2002 | McFarland et al. | |

(Continued)

FOREIGN PATENT DOCUMENTS

| | | |
|---|---|---|
| DE | 196 46 937 A1 | 5/1998 |

(Continued)

*Primary Examiner*—Ching Chang
(74) *Attorney, Agent, or Firm*—Dickinson Wright PLLC

(57) ABSTRACT

An electromechanical valve actuator including an electromagnet interconnected with a housing end portion and an electric coil disposed adjacent said electromagnet. The electromagnet includes a plurality of interlocked laminae to form a laminate that is similarly interlocked with housing end portions. The housing end portions are interlocked with the laminate with the use of tabs and recesses formed on the laminae and the housing end portions.

13 Claims, 6 Drawing Sheets

U.S. PATENT DOCUMENTS

| | | | | |
|---|---|---|---|---|
| 6,516,758 | B1 | 2/2003 | Leiber | |
| 6,517,044 | B1 | 2/2003 | Lin et al. | |
| 6,526,928 | B2 | 3/2003 | Bauer et al. | |
| 6,546,904 | B2 | 4/2003 | Marchioni et al. | |
| 6,561,144 | B1 | 5/2003 | Muraji | |
| 6,701,606 | B2 * | 3/2004 | Smith et al. | 29/602.1 |
| 2001/0006047 | A1 | 7/2001 | Oyama et al. | |
| 2002/0057154 | A1 | 5/2002 | Keck | |
| 2002/0145124 | A1 | 10/2002 | Kabasin et al. | |
| 2003/0034470 | A1 | 2/2003 | Padroni | |
| 2003/0056743 | A1 | 3/2003 | Cristiani et al. | |
| 2003/0168030 | A1 | 9/2003 | Muraji | |
| 2004/0108482 | A1 | 6/2004 | Sakuragi et al. | |
| 2005/0076866 | A1 * | 4/2005 | Hopper et al. | |

FOREIGN PATENT DOCUMENTS

| | | |
|---|---|---|
| DE | 297 06 491 U1 | 8/1998 |
| EP | 0 967 623 A1 | 12/1999 |
| JP | 6-45137 | 2/1994 |
| JP | 2002-134316 | 5/2002 |

* cited by examiner

ELECTROMAGNET ASSEMBLY FOR ELECTROMECHANICAL VALVE ACTUATORS

BACKGROUND OF THE INVENTION

The present invention relates to an electromagnet assembly for use in connection with electromechanical valve actuators and a method of assembling an electromagnet for use in connection with electromechanical valve actuators.

As engine technology advances and manufacturers strive to increase engine power, improve fuel economy, decrease emissions, and provide more control over engines, manufacturers are developing electromechanical valve actuators to replace cam shafts for opening and closing engine valves.

Electromechanical valve actuators allow selective opening and closing of the valves in response to various engine conditions. Electromechanical valve actuators generally include two electromagnets formed from a lamination stack and with embedded power coil. A spring loaded armature located between the electromagnets is movable between the electromagnets as the power coils are selectively energized to create a magnetic force to attract the armature. The surface of the electromagnets to which the armature is attracted when the power coil of an electromagnet is energized is generally referred to as a pole face. The armature is attached to the valve so that as the armature moves between pole faces in pole-face-to-pole-face operation, the valve is opened and closed.

Electromagnet assemblies for electromechanical valve actuators are traditionally formed by assembling two electromagnets, each having an electric coil, into a housing. The electromagnets are formed by laminating a plurality of magnetic laminae to form a lamination core. Each laminae is interlocked with the adjoining laminae with the use of tabs on each laminae. In some cases, various holes are machined into the lamination core providing, for example, for armature stems.

With the lamination core formed, a power coil may be inserted within a coil cavity on the lamination core. The power coil is held in place by filling voids in the cavity with epoxy. The assembled electromagnets are then secured to a housing. In some cases, the housing includes the use of c-channels with fasteners. For example, the electromagnet may be bolted to the c-channel, or a bolt may pass through a passage on each side of the electromagnet and couple the electromagnet to each side of the c-channel. Properly positioning the electromagnets within the c-channels during assembly is difficult due to various tolerance stack ups. In most cases, the positioning requires the use of location features such as pins or encapsulants. Properly assembling the c-channels into a complete electromechanical valve actuator with the armature plate between the electromagnets so that the pole faces of linear electromagnets are parallel with the armature plate and so that the stem passages in the closed electromagnet and open electromagnet are aligned is difficult and time consuming. Any misalignment of the armature stem passage creates excessive wear and friction caused heat.

SUMMARY OF THE INVENTION

An electromechanical valve actuator including an electromagnet interconnected with a housing end portion and an electric coil disposed adjacent said electromagnet. The electromagnet includes a plurality of interlocked laminae to form a laminate that is similarly interlocked with housing end portions. The housing end portions are interlocked with the laminate with the use of tabs and recesses formed on the laminae and the housing end portions.

Further scope of applicability of the present invention will become apparent from the following detailed description, claims, and drawings. However, it should be understood that the detailed description and specific examples, while indicating preferred embodiments of the invention, are given by way of illustration only, since various changes and modifications within the spirit and scope of the invention will become apparent to those skilled in the art.

BRIEF DESCRIPTION OF THE DRAWINGS

The present invention will become more fully understood from the detailed description given here below, the appended claims, and the accompanying drawings in which:

DETAILED DESCRIPTION OF THE PREFERRED EMBODIMENT

Figure 1:
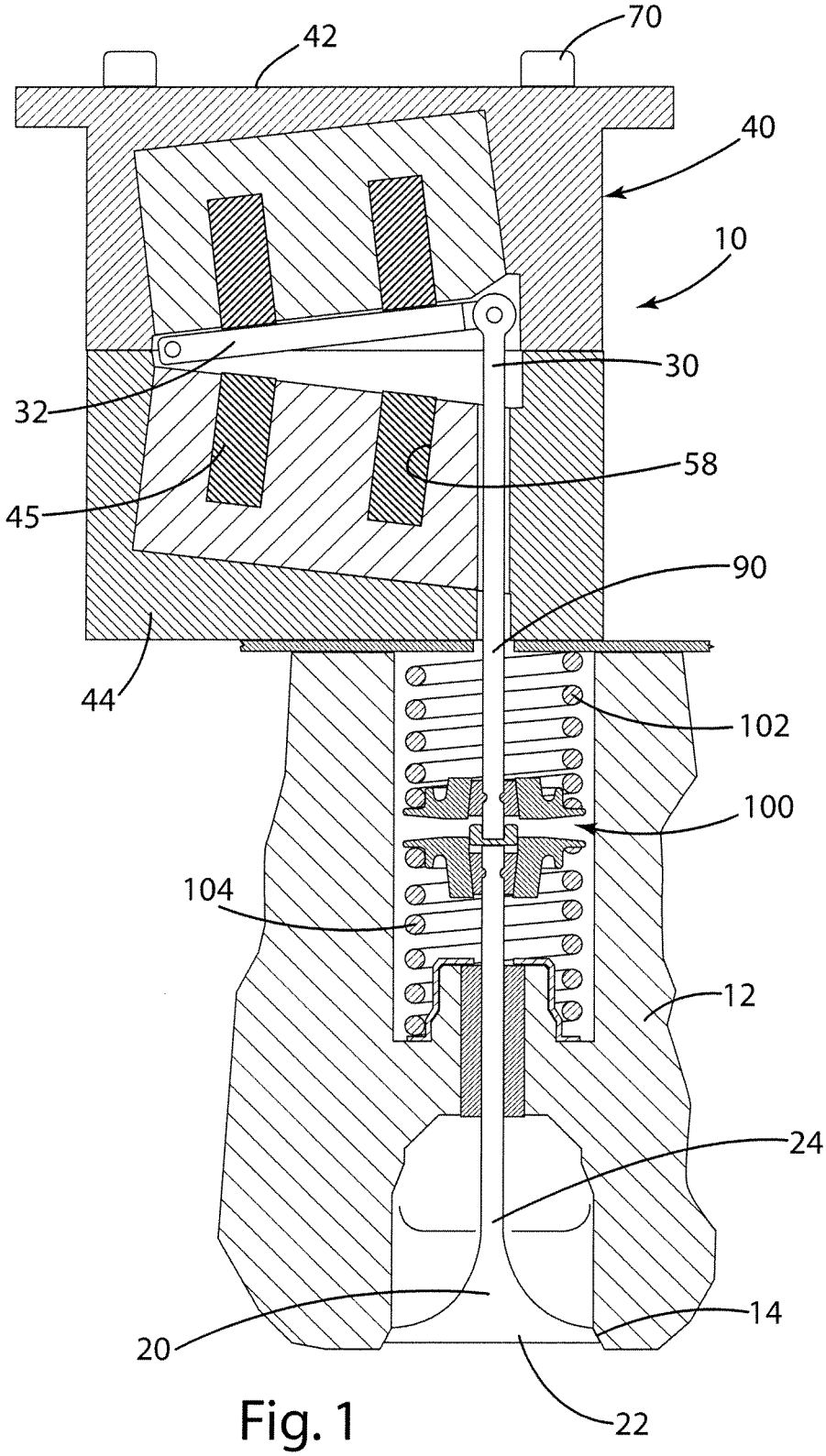
FIG. 1 is a sectional view of a lever type electromechanical valve actuator.

A single lever electromechanical valve actuator 10, typically mounted on an internal combustion engine 12 to open and close a valve 20 (e.g., the intake or exhaust valves), is illustrated in FIG. 1. The electromechanical valve actuator 10 generally includes an armature assembly 30 having an armature plate 32, an electromagnet assembly 40 having electromagnets 42, 44, a connecting rod 90 and a spring assembly 100. The armature plate 32 is alternatively attracted to the electromagnets 42, 44, thereby applying a bi-directional force to the spring assembly 100 through the connecting rod 90 to open and close the valve 20. The valve 20 is similar to traditional valves and generally includes a valve head 22 with a valve stem 24 extending therefrom. The valve 20 has an open and a closed position wherein in the closed position the valve head 22 seals a valve port 14 to the corresponding cylinder (not shown). The spring assembly 100 includes springs 102 and 104 sized to bias the armature plate 32 into an intermediate position (not shown) while the electromagnets 42, 44 are not energized through an electric coil 45.

Figure 2:
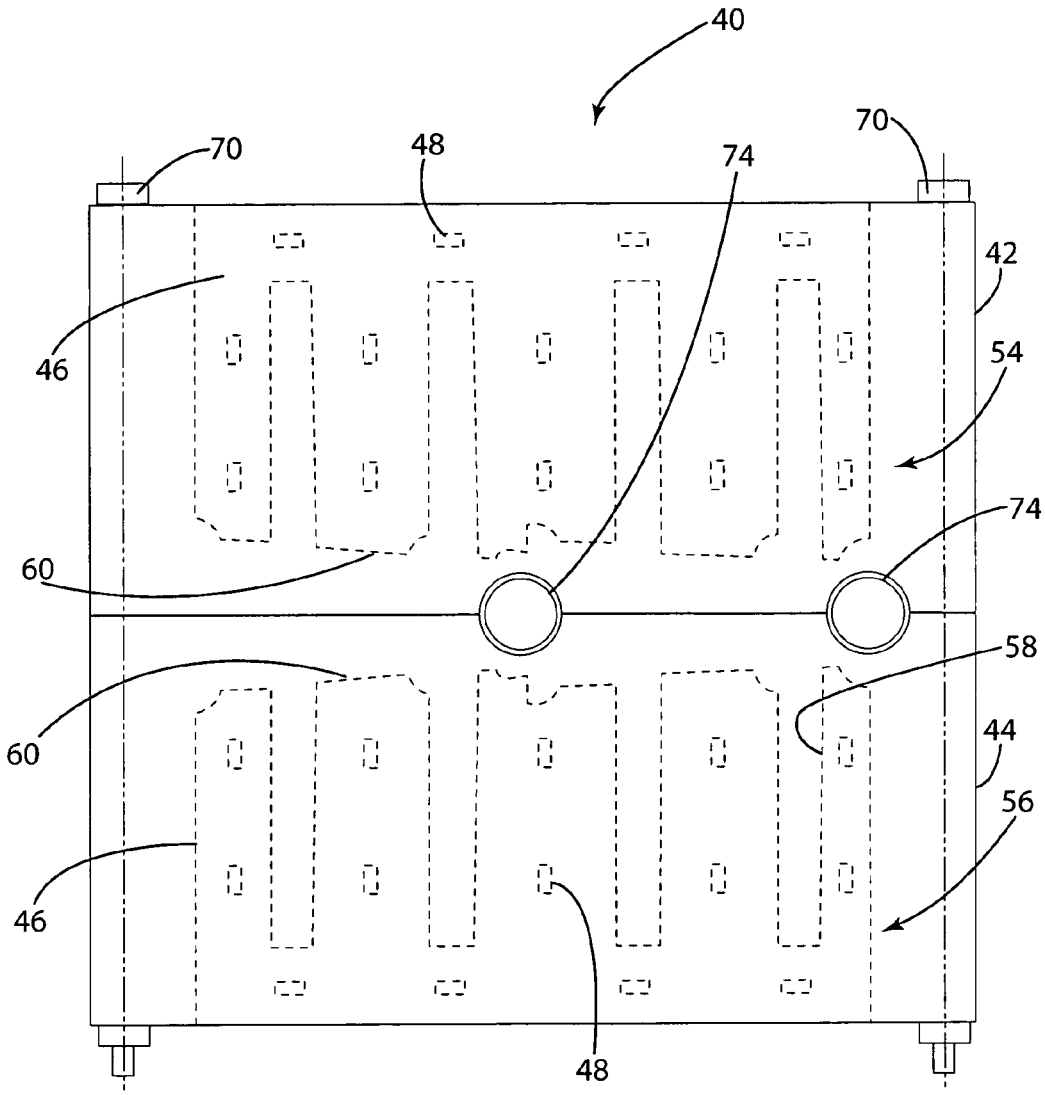
FIG. 2 is a side view of an electromagnet assembly with two electromagnets shown in phantom.

The present invention relates to the electromagnet assembly 40 and a method of assembling an electromagnet 42, 44. As shown in FIG. 2 the electromagnet assembly 40 includes the electromagnets 42, 44 also referred to as the armature electromagnet 42 and the valve electromagnet 44. Each electromagnet 42, 44 includes an electric coil pocket 58 for holding the electric coil 45 and housing end portions shown generally at 54, 56.

Figure 7:
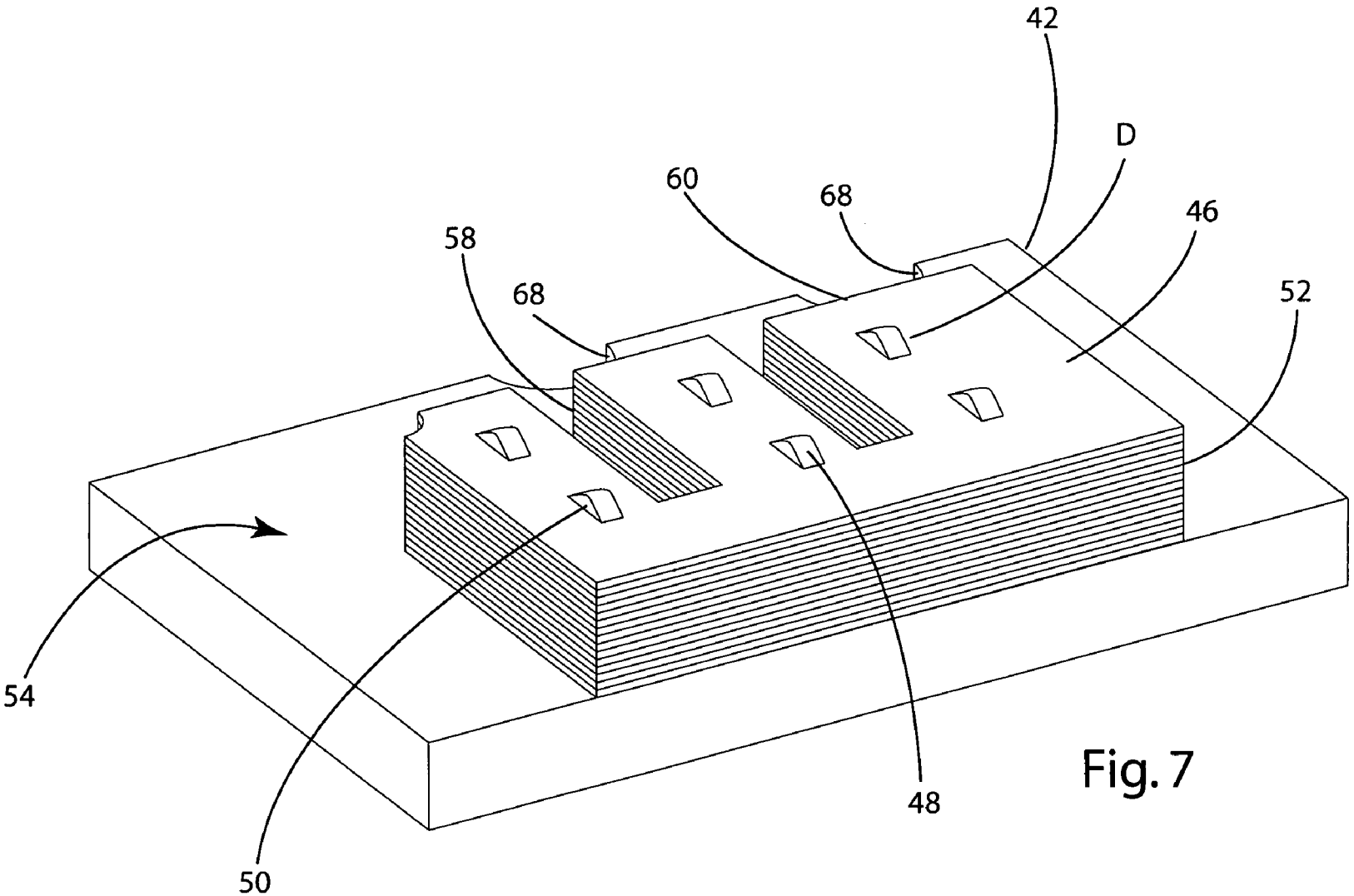
FIG. 7 is a perspective view of an electromagnet assembled with a housing end portion.

As shown in FIG. 2 and FIG. 7, the electromagnets 42, 44 include laminate cores 46 which are formed from a plurality of interlocked laminae 52 to improve the magnetic efficiency of the electromagnets 42, 44. The laminate cores 46 are shaped to provide the electric coil pocket 58 and in some cases may include bores (not shown) to provide for armature stems.

Figure 5:
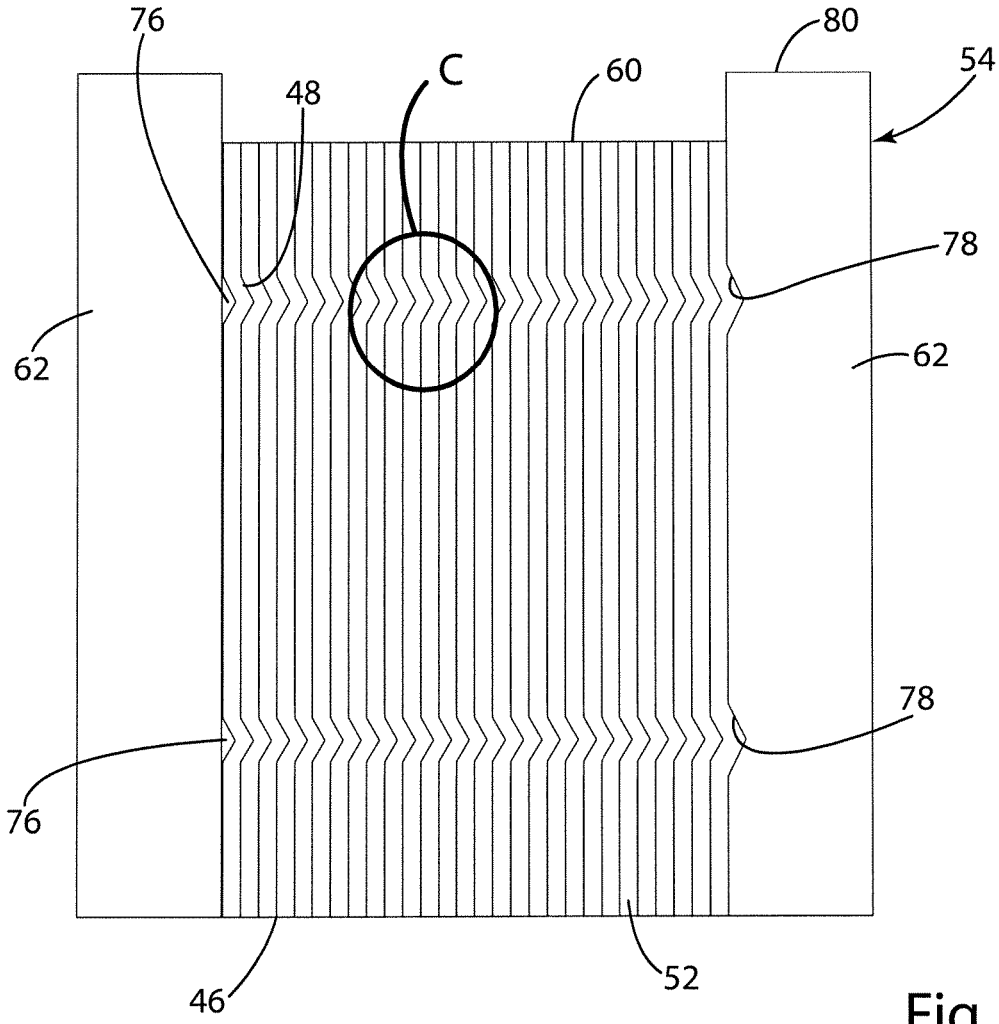
FIG. 5 is an end view taken along line B-B of FIG. 4.
Figure 6:
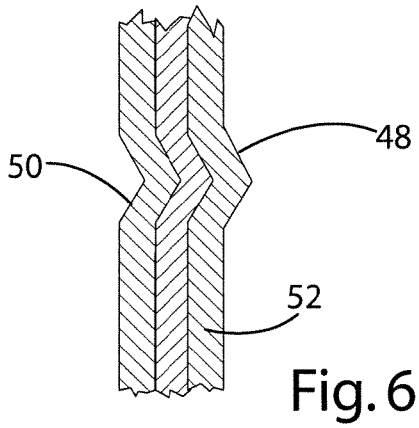
FIG. 6 is an enlarged view of detail C from FIG. 5 showing interlocking laminae.

The laminae 52 are formed by stamping thin magnetic sheets of material. In the illustrated embodiment, each sheet is approximately 0.014 inches thick. In order to interlock the laminae to form the laminate cores 46, each laminae is formed with a tab 48 having a recess 50 as best shown in FIGS. 5-7. It should be appreciated that many various types of tabs can be formed on the sheet material including, for example, a circular or cantilevered tab. After a plurality of each laminae 52 with tabs 48 and recesses 50 are formed, each laminae 52 is aligned along an axis D defined by the tabs and recesses, and pressed together to cause the tabs 48 of each laminae to be matingly received into the adjacent laminae recess 50 to thereby interlock each laminae 52 with an adjacent laminae 52. More specifically, each tab 48 and recess 50 is formed in a manner to cause an interference fit between each tab 48 and each recess 50. When forming the laminate core 46 it is important to maintain the precise alignment of each laminae 52 in order to permit an appropriately aligned pole face 60 for mating with the armature plate 32 as described above.

Figure 3:
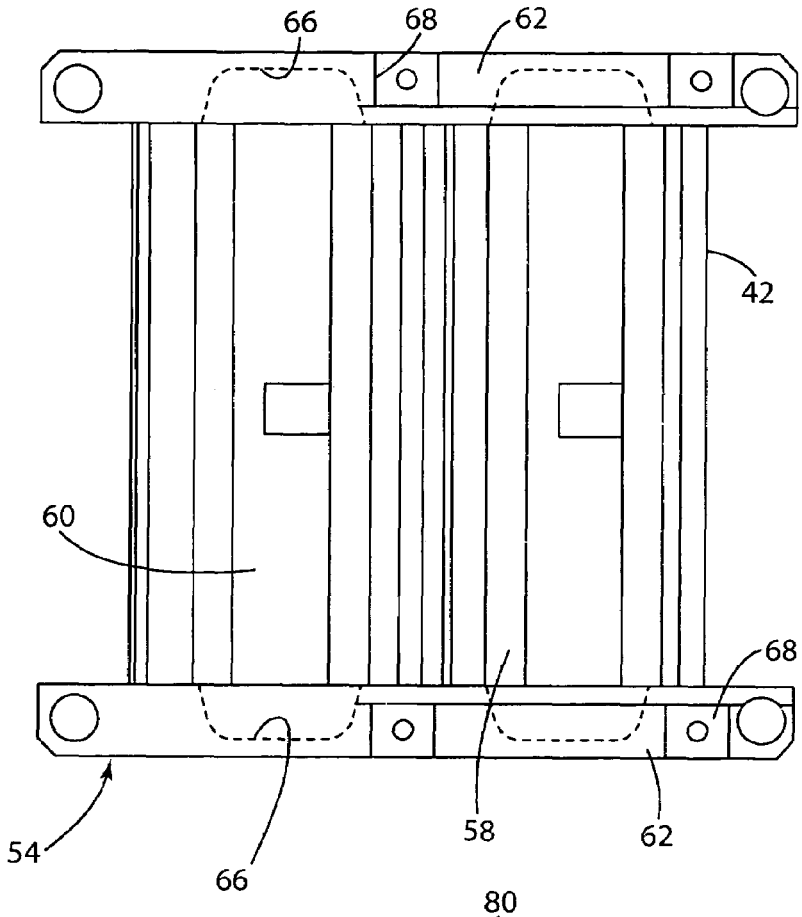
FIG. 3 is a top view of an electromagnet assembled with end housings.
Figure 4:
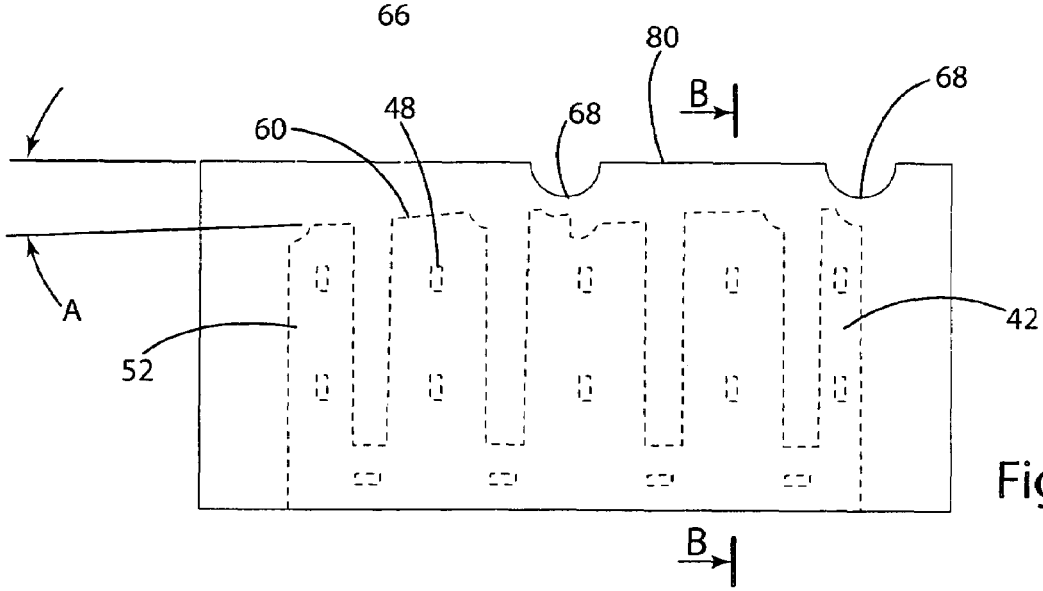
FIG. 4 is a side view of the electromagnet shown in FIG. 3 with the electromagnet shown in phantom.
Figure 8:
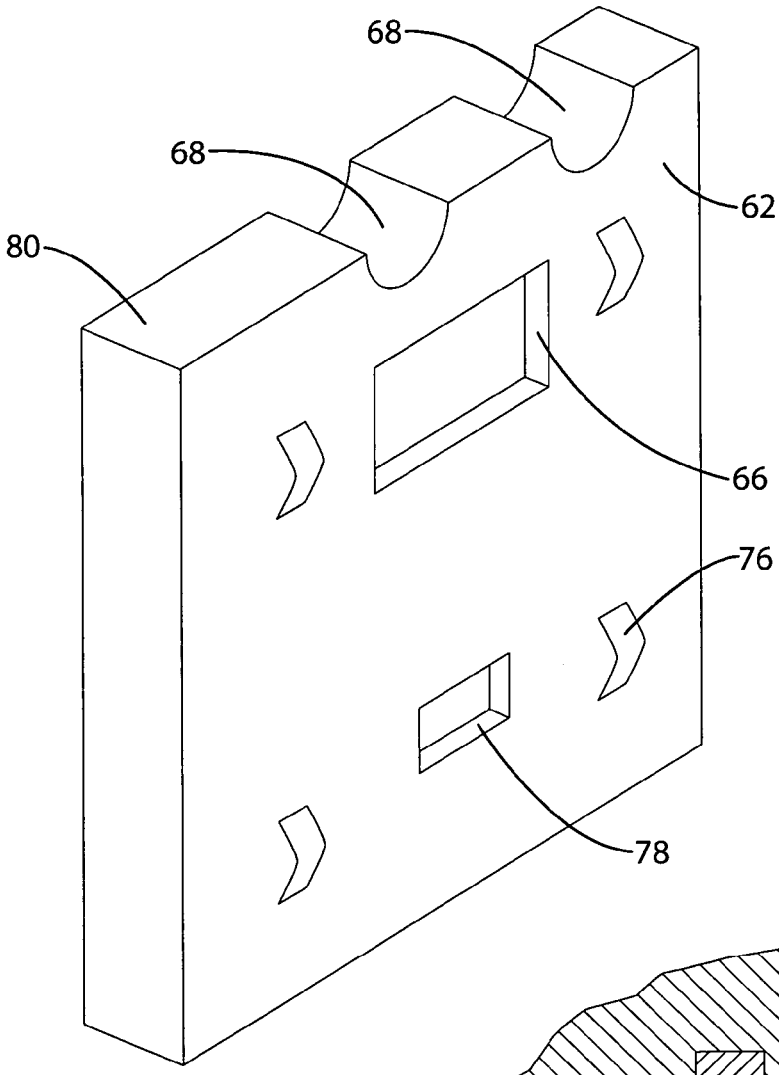
FIG. 8 is a perspective view of a housing end portion.

As is shown in FIG. 3, each electromagnet 42, 44 includes a pair of housing end portions 62 for mounting the electromagnets 42, 44 to each other and for mounting the electromagnet assembly to the engine 12 with the use of bolts 70. It should be appreciated that many other various means may be used to fasten the electromagnets 42, 44 to the engine 12. Each housing end portion 62 includes an electric coil pocket 66 for receiving at least a portion of an electric coil (not shown), as shown in FIG. 8. In the illustrated embodiment, the coil pocket 66 is shown as a rectangle shape however, it should be appreciated that such pocket 66 can also be other shapes such as partially spherical. Each housing end portion 62 includes a bearing surface 68 for axially supporting a pivot shaft (not shown) or bushing 74. The housing end portions 62 include stakes 76 for being received in the recesses 50 of the laminae 52 in order to interlock a housing end portion 62 with the laminate core 46. In addition, housing recesses 78 may also be formed on the housing end portion 62 in order to matingly receive the tabs 48 of the laminae 52. More specifically, each stake 76 and housing recess 78 is formed in a manner to cause an interference fit between each recess 50 and tab 48 of the laminae, respectively. When interlocking the housing end portion 62 to the laminate core 46 it is important to maintain a precise alignment between the core 46 and the housing end portion 62 in order to precisely align the angular position A of the pole face 60 with respect to a top surface 80 of the housing end portion 62, as shown in FIG. 4, in order to preserve an appropriate interaction with the armature plate 32. As opposed to the prior art use of c-channels for assembling and housing electromagnets, the use of housing end portions 62 interlocked with the laminate core 46 provides less error resulting from tolerance variation.

In the illustrated embodiment, the housing end portions 62 are formed by casting non-magnetic material such as stainless steel. Since the housing end portions 62 are cast, the bearing surface 68, the stakes 76, the housing recesses 78 and the coil pocket 66 can all be integrally cast. As such, it should be appreciated that many different types of staking and recesses can be cast and utilized for interlocking to the laminate core 46 provided an interference fit is maintained.

Figure 9:
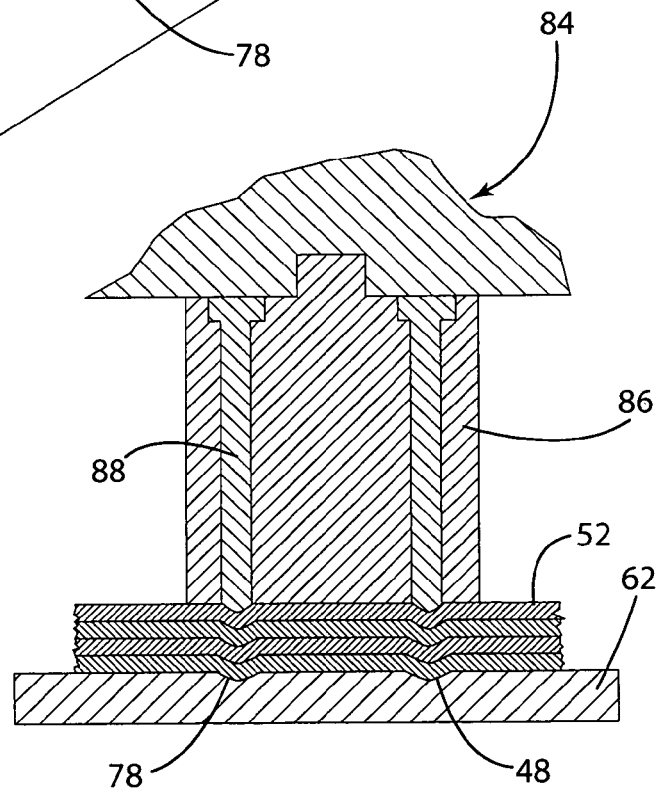
FIG. 9 is a sectional side view of a stamping tool assembling a plurality of laminae to a housing end portion.

As shown in FIG. 9, each electromagnet 42, 44 is assembled with a press 84 for pressing each aligned laminae 52 together in order to form the laminate core 46 and for interconnecting each housing end portion 62 to each laminate core 46. In the illustrated embodiment, the press 84 includes a jig 86 for aligning and holding the laminate core 46 to the housing end portion 62 while using a ram 88 for pressing down onto the laminate core 46 to thereby cause the tab 48 of the laminate core 46 to be interferingly received in the housing recess 78. Also, in interconnecting the other housing end with the laminate core 46, the press 84 may be provided to interconnect the stakes 76 of the housing end portion 62 with the recesses 50 of the laminate core 46. In the illustrated embodiment, the press 84 is shown to include only one of the housing end portions 62 being interconnected with the laminate core 46, it should be appreciated that the same press 84 may be used to interconnect both housing end portions 62 to the laminate core 46 either simultaneously or, after adjusting the ram 88, in a sequenced manner. By providing a method of assembling the laminate core 46 to the housing end portions 62 in an interlocking manner and in the same press, it should be appreciated that many of the prior art deficiencies with respect to tolerance variation are reduced. In addition, locating features such as pins or encapsulants can be reduced or eliminated due to the use of the interlocking assembly and the use of a single press.

Each electromagnet 42, 44 having the electric coil and housing end portions 62 interlocked to the laminate core 46 is then provided with an epoxy in the coil pockets 58 of the laminate core 46 and coil pockets 66 of the housing end portions 62. The epoxy is provided to bind the coil to the electromagnet and in some cases will assist with connecting the housing end portions 62 to the electromagnets 42, 44.

In the illustrated embodiment, the electromagnet assembly 40 is provided for use with a lever electromechanical actuator, it should be appreciated that the present invention may also be used in connection with a linear electromagnet assembly.

The foregoing discussion discloses and describes an exemplary embodiment of the present invention. One skilled in the art will readily recognize from such discussion, and from the accompanying drawings and claims that various changes, modifications and variations can be made therein without departing from the true spirit and fair scope of the invention as defined by the following claims.

What is claimed is:

1. An electromechanical valve actuator comprising:

an electromagnet including a plurality of interlocked laminae, at least one of said laminae having a tab;

a housing end portion having a recess formed for matingly receiving said tab for interlocking said housing end portion to said plurality of interlocked laminae; and an electric coil disposed adjacent said electromagnet.

2. The electromechanical valve actuator of claim 1 wherein said housing end portion includes a bushing surface.

3. The electromechanical valve actuator of claim 1 wherein said housing end portion includes a coil pocket for receiving at least a portion of said electric coil.

4. The electromechanical valve actuator of claim 1 including at least one of said laminae having a slot wherein said housing end portion includes a stake formed for being received in said slot for interlocking said housing end portion to said plurality of interlocked laminae.

5. The electromechanical valve actuator of claim 4 including a second housing end portion having a stake formed for being matingly received in said slot for interlocking said second housing end portion to said plurality of interlocked laminae.

6. The electromechanical valve actuator of claim 1 wherein said electromagnet includes a pole face having a predetermined angular position with respect to a top surface of said housing end portion.

7. An electromechanical valve actuator comprising:

an electromagnet including a plurality of interlocked laminae, at least one of said laminae having a slot;

a housing end portion having a stake formed for being matingly received in said slot for interlocking said housing end portion to said plurality of interlocked laminae; and an electric coil disposed adjacent said electromagnet.

8. The electromechanical valve actuator of claim 7 wherein said electromagnet includes a pole face having a predetermined angular position with respect to a top surface of said housing end portion.

9. The electromechanical valve actuator of claim 7 wherein said housing end portion includes a bushing surface.

10. The electromechanical valve actuator of claim 7 wherein said housing end portion includes a coil pocket for receiving at least a portion of an electric coil.

11. An electromagnet assembly for an electromechanical valve actuator comprising:

an armature electromagnet including a plurality of armature laminae interlocked to form a armature laminate and interlocked with armature housing end portions;

a valve electromagnet including a plurality of valve laminae interlocked to form a valve laminate and interlocked with valve housing end portions; and wherein at least one of said armature housing and one of said valve housing include tabs for engaging the respective armature laminae or valve laminae.

12. The electromagnet assembly for an electromechanical valve actuator of claim 11 wherein at least one of said armature laminae include tabs for interlocking said armature laminae and for interlocking said armature laminate to said armature housing end portions.

13. The electromagnetic core assembly for an electromechanical valve actuator of claim 11 wherein at least one of said valve laminae include tabs for interlocking said valve laminae and for interlocking said valve laminate to said valve housing end portions.

* * * * *